US007938702B2

(12) United States Patent
Suzuki et al.

(10) Patent No.: US 7,938,702 B2
(45) Date of Patent: May 10, 2011

(54) BOAT PROPULSION SYSTEM AND BOAT INCLUDING THE SAME

(75) Inventors: Takayoshi Suzuki, Shizuoka (JP); Daisuke Nakamura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 224 days.

(21) Appl. No.: 12/389,480

(22) Filed: Feb. 20, 2009

(65) Prior Publication Data

US 2009/0215336 A1 Aug. 27, 2009

(30) Foreign Application Priority Data

Feb. 22, 2008 (JP) ..... 2008-042232

(51) Int. Cl.
*B63H 21/21* (2006.01)

(52) U.S. Cl. ..... 440/1; 440/86; 440/87

(58) Field of Classification Search ..... 440/1, 84, 440/86, 87; 701/21; 74/473.12, 473.14
See application file for complete search history.

(56) References Cited

U.S. PATENT DOCUMENTS 5,242,320 A * 9/1993 Schmidt et al. ..... 440/86
6,238,255 B1 * 5/2001 Takase ..... 440/1
6,485,340 B1 * 11/2002 Kolb et al. ..... 440/84
7,247,066 B2 * 7/2007 Harada et al. ..... 440/84
7,267,593 B2 * 9/2007 Oguma et al. ..... 440/86
7,524,222 B2 * 4/2009 Ochiai ..... 440/84
7,690,956 B2 * 4/2010 Ito et al. ..... 440/1
2003/0054704 A1 * 3/2003 Kanno ..... 440/1
2007/0232162 A1 10/2007 Okuyama et al.

FOREIGN PATENT DOCUMENTS

JP 2007-246014 A 9/2007

* cited by examiner

*Primary Examiner* — Lars A Olson
(74) *Attorney, Agent, or Firm* — Keating & Bennett, LLP

(57) ABSTRACT

A boat propulsion system includes a shift mechanism arranged to change a shift position among forward, neutral, and reverse. A shift position detection mechanism is connected to a control lever with a wire. The shift position detection mechanism has a detected member and a position detection section. The detected member is displaced corresponding to an operation position of the control lever as the control lever is operated. The position detection section detects a position of the detected member. The position detection section outputs a shift position signal corresponding to the detected position of the detected member. A control device controls the shift position of the shift mechanism on the basis of the shift position signal. The boat propulsion system provided with the shift mechanism of an electronic control type can replace a boat propulsion system provided with a shift mechanism of a mechanical type at low cost.

15 Claims, 12 Drawing Sheets

BOAT PROPULSION SYSTEM AND BOAT INCLUDING THE SAME

BACKGROUND OF THE INVENTION

1. Field of the Invention

The present invention relates to a boat propulsion system and a boat including the same.

2. Description of the Related Art

Conventionally, there is known a boat propulsion system provided with a shift mechanism of an electronic control type operated by a remote controller having a remote control lever. The boat propulsion system provided with the shift mechanism of the electronic control type operated by the remote controller needs to be provided with a position sensor disposed in the remote controller in relation to the remote control lever, for example, as described in JP-A-2007-246014. The position sensor detects a position of the remote control lever. The position sensor outputs the position of the remote control lever as a shift position signal. An ECU (electronic control unit) provided with the boat propulsion system controls the shift mechanism on the basis of the shift position signal.

There is also a boat propulsion system provided with a shift mechanism of a mechanical type. Here, the shift mechanism of the mechanical type refers to a shift mechanism in which a shift position of the shift mechanism is directly operated by a wire that moves as a result of the remote control lever being operated by an operator. There may be a case where it is necessary to satisfy a request that the boat propulsion system provided with the shift mechanism of a mechanical type is replaced by a boat propulsion system provided with the shift mechanism of an electronic control type.

For example, when replacement is performed with a conventional boat propulsion system provided with a shift mechanism of the electronic control type, it is difficult to use a remote controller for the boat propulsion system provided with the shift mechanism of a mechanical type even after the replacement. Normally, it becomes necessary to replace the remote controller for the boat propulsion system provided with the shift mechanism of a mechanical type with a remote controller having a position sensor. Therefore, there is a problem of a large cost to replace the boat propulsion system provided with the shift mechanism of the mechanical type with a boat propulsion system provided with the shift mechanism of the electronic control type.

SUMMARY OF THE INVENTION

In order to overcome the problems described above, preferred embodiments of the present invention provide a boat propulsion system provided with a shift mechanism of an electronic control type that can replace a boat propulsion system provided with a shift mechanism of a mechanical type at low cost.

The boat propulsion system according to a preferred embodiment of the present invention is operated by a control lever for an operator to switch a shift position. The boat propulsion system according to a preferred embodiment of the present invention is preferably provided with a power source, a propeller, a shift mechanism, a shift position detection mechanism, and a control device. The propeller is driven by the power source. The shift mechanism is disposed between the power source and the propeller. The shift mechanism switches a shift position among forward, neutral, and reverse. The shift position detection mechanism is connected to the control lever by a wire. The shift position detection mechanism has a detected member and a position detection section. The detected member is displaced to a position corresponding to an operation position of the control lever as a result of the control lever being operated. The position detection section is arranged to detect a position of the detected member, and to output a shift position signal corresponding to the detected position of the detected member. The control device controls a shift position of the shift mechanism on the basis of the shift position signal.

A boat according to a preferred embodiment of the present invention includes the boat propulsion system as described above, and the control lever for the operator to switch the shift position.

The preferred embodiments of the present invention provide a boat propulsion system provided with a shift mechanism of an electronic control type that can replace a boat propulsion system provided with a shift mechanism of a mechanical type at low cost.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

One example of a preferred embodiment of the present invention will be described hereinafter with reference to an outboard motor 20 shown in FIG. 1 as an example of a boat propulsion system. However, the preferred embodiments described below are only examples of preferred embodiments that achieve the advantages and benefits of the present invention. The present invention is not limited to the preferred embodiments described below. The boat propulsion system according to a preferred embodiment of the present invention may be, for example, a so-called inboard engine or a so-called stern drive. The stern drive is also referred to as an inboard-outdrive engine. The "stern drive" refers to a boat propulsion system that has at least a power source mounted on a hull. The "stern drive" also includes a system that has something other than a propulsion unit mounted on a hull.

Figure 1:
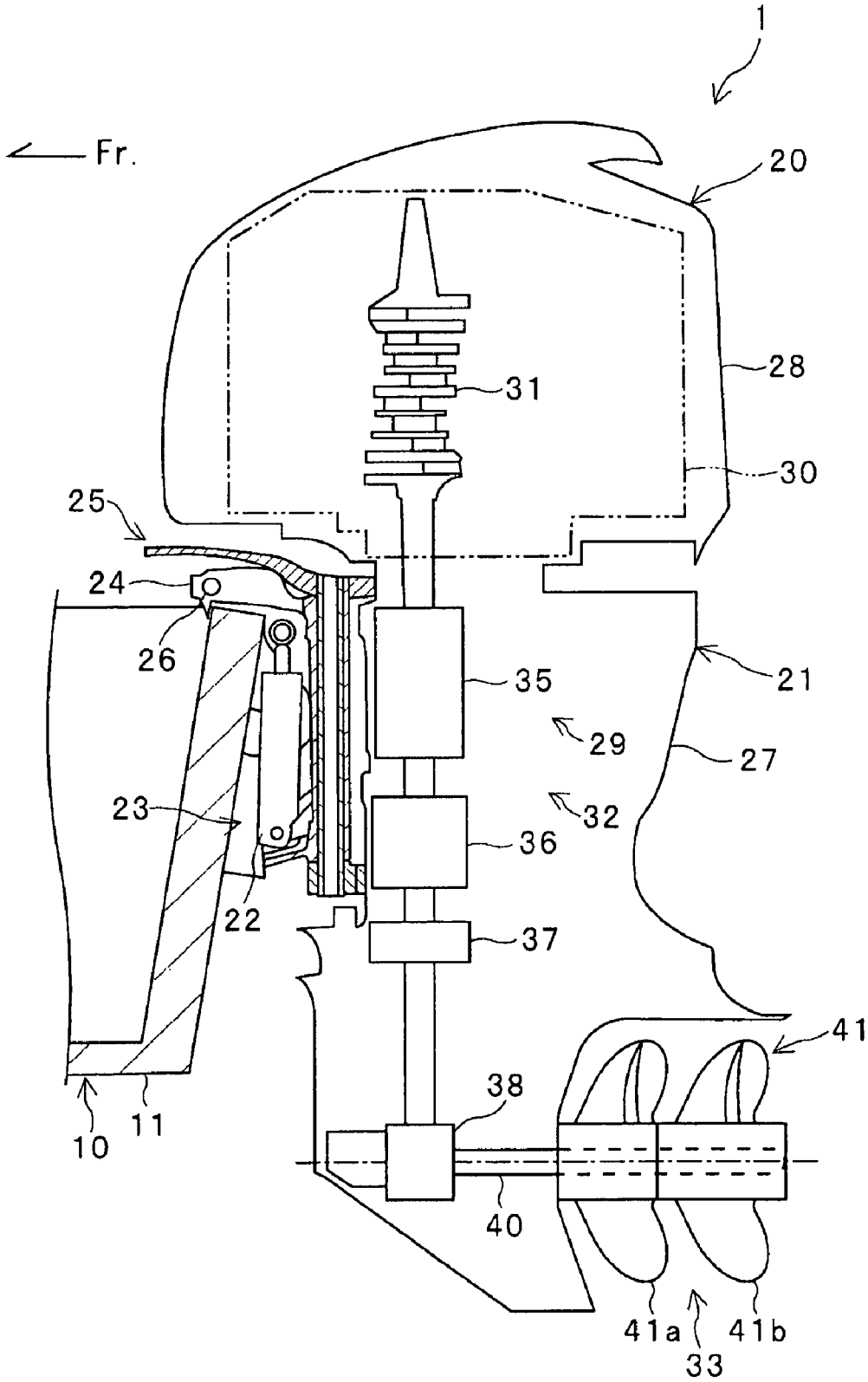
FIG. 1 is a partial cross-sectional view of a stern portion of a boat according to a preferred embodiment of the present invention as viewed from a side of the boat.

FIG. 1 is a schematic partial cross-sectional view of a portion of a stern 11 of a boat 1 according to a preferred embodiment of the present invention as viewed from a side of the boat 1. The boat 1 is provided with a hull 10, the outboard motor 20, and a controller 82 as a control device shown in FIG. 3.

Figure 3:
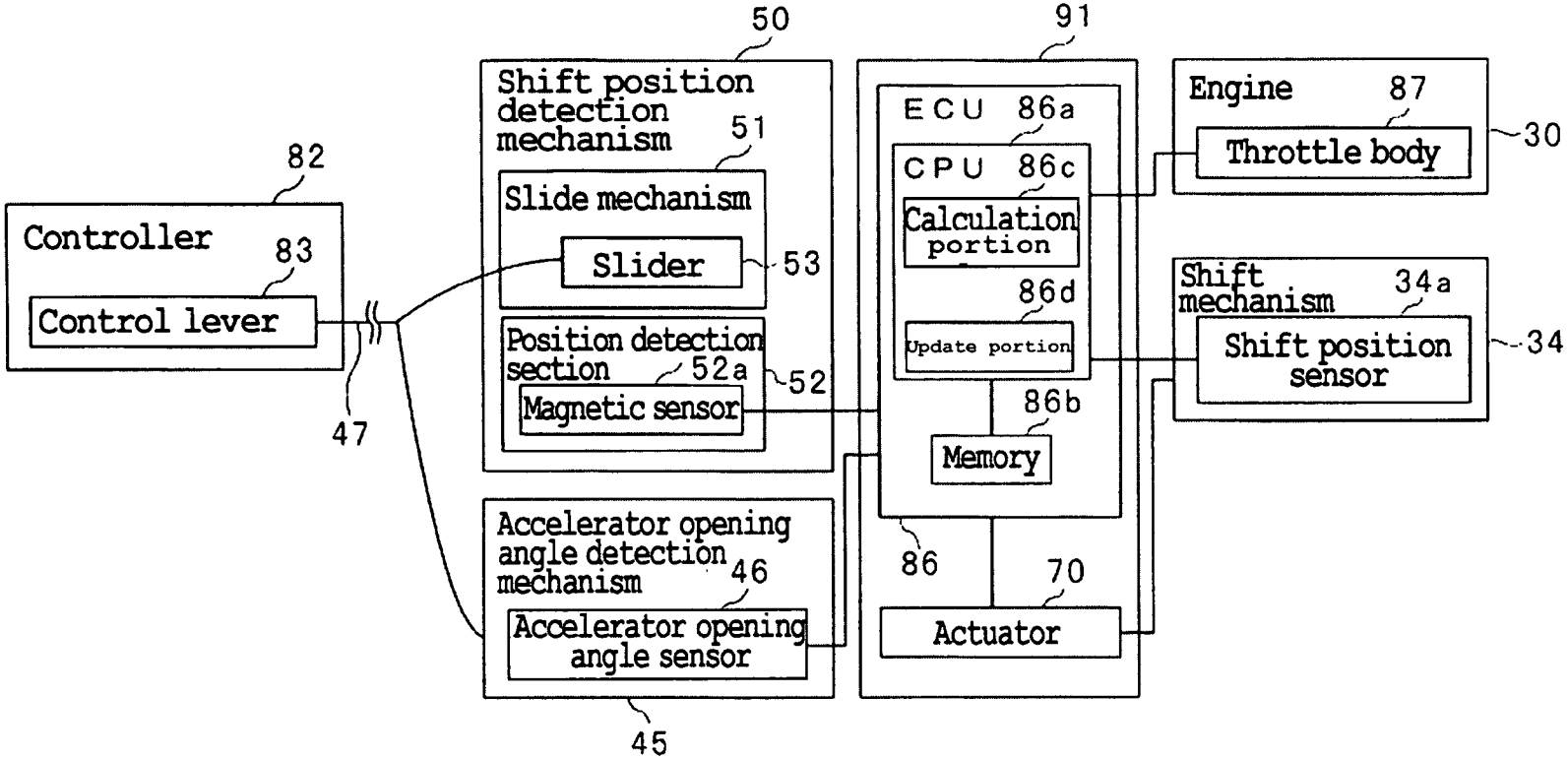
FIG. 3 is a control block diagram of the boat.

The controller 82 controls the boat 1. The controller 82 is provided with a control lever 83, which is rotatably operable as shown in FIG. 3 and in FIG. 6. As the operator operates the control lever 83, an accelerator opening and a shift position are output.

Figure 6:
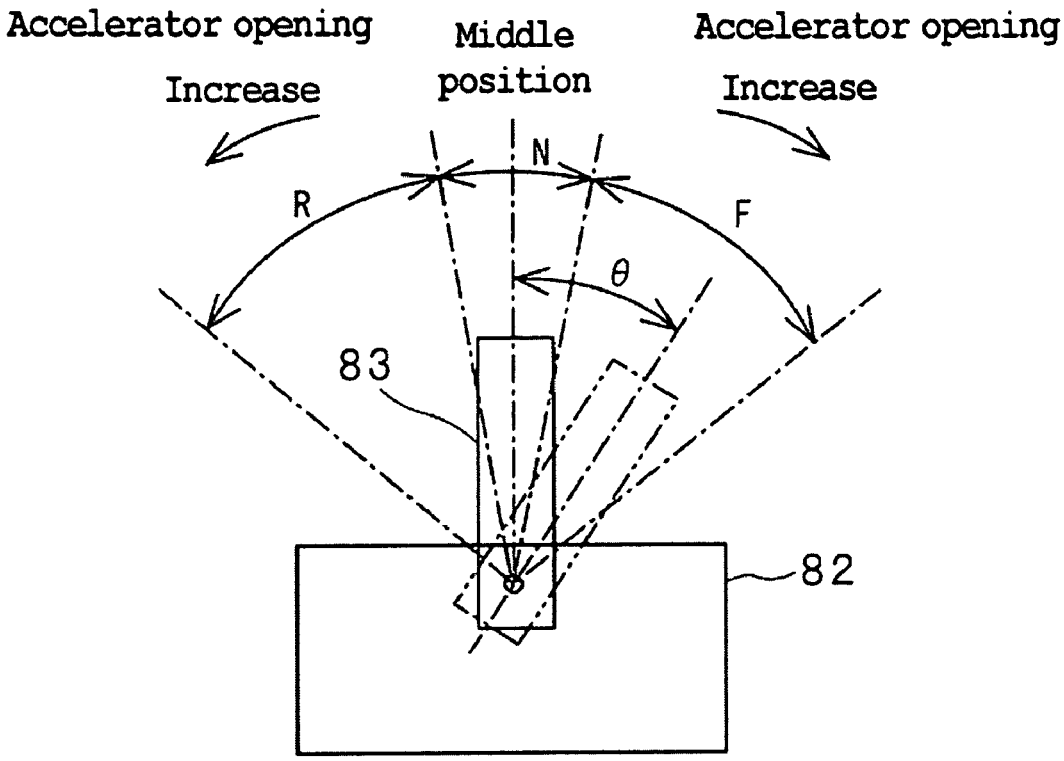
FIG. 6 is a schematic side view of a controller.

Specifically, as shown in FIG. 6, when the control lever 83 is maintained in a neutral area denoted by "N" by the operator, the shift position stays neutral. On the other hand, when the control lever 83 is maintained in a forward area denoted by "F" by the operator, the shift position is forward. When the control lever 83 is maintained in a reverse area denoted by "R" by the operator, the shift position is reverse.

Further, as an operation amount of the control lever 83 becomes larger in the forward area or in the reverse area, the input accelerator opening becomes larger. Specifically, as an operation angle θ of the control lever 83 with respect to the neutral position becomes larger in the forward area or in the reverse area, the input accelerator opening also becomes larger.

General Configuration of the Outboard Motor 20

As shown in FIG. 1, the outboard motor 20 is mounted on the stern 11 of the hull 10. The outboard motor 20 is mounted with a shift position detection mechanism 50 described below. The outboard motor 20 is provided with an outboard motor main body 21, a tilt/trim mechanism 22, and a bracket 23.

The bracket 23 is provided with a mount bracket 24 and a swivel bracket 25. The mount bracket 24 is fixed on the hull 10. The swivel bracket 25 is swingable around a pivot 26 with respect to the mount bracket 24.

The tilt/trim mechanism 22 performs a tilting operation and a trimming operation of the outboard motor main body 21. Specifically, the tilt/trim mechanism 22 swingably operates the swivel bracket 25 with respect to the mount bracket 24.

The outboard motor main body 21 is provided with a casing 27, a cowling 28, a propulsive force generation device 29, the shift position detection mechanism 50, and an accelerator opening detection section 45.

Figure 2:
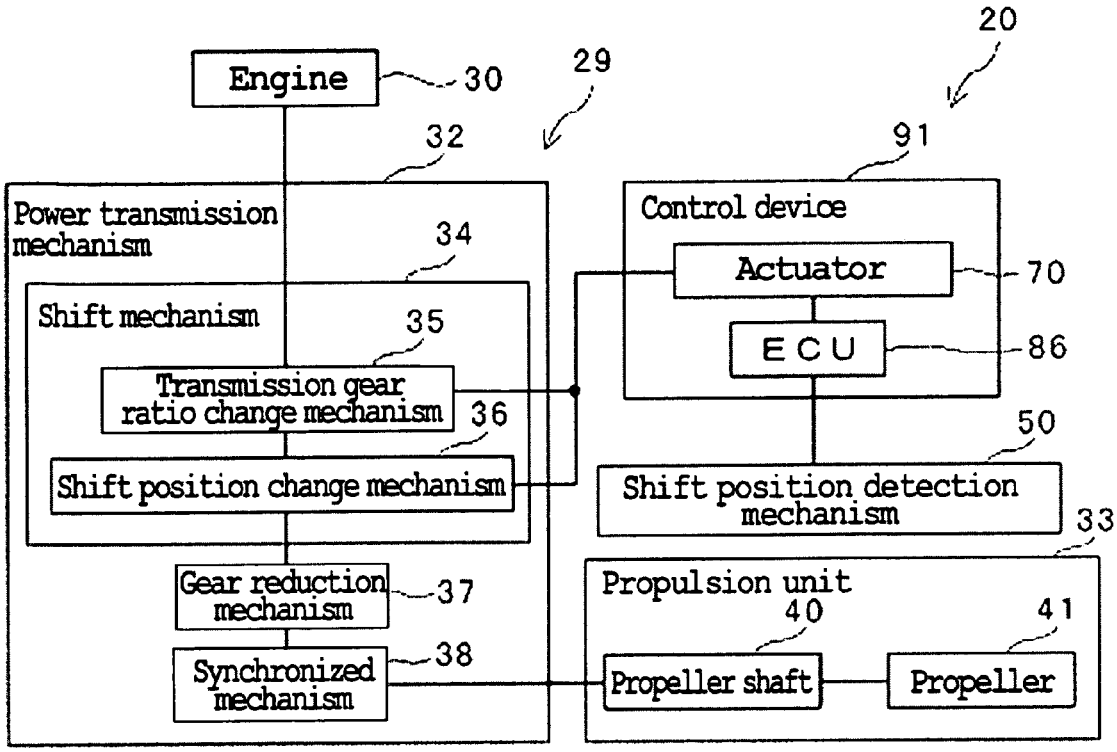
FIG. 2 is a schematic structure diagram showing a structure of a propulsive force generation device.

As shown in FIG. 1 and FIG. 2, the propulsive force generation device 29 is preferably provided with an engine 30, a power transmission mechanism 32, and a propulsion unit 33.

In the present preferred embodiment, an example in which the outboard motor 20 has the engine 30 as a power source will be described. However, the power source is not limited particularly as long as the power source can generate a rotational force. For example, the power source may be an electric motor.

The engine 30 is an engine of a fuel injection type that has a throttle body 87 shown in FIG. 3. As a throttle opening is adjusted, the engine rotational speed and the engine output of the engine 30 are adjusted. As shown in FIG. 1, the rotational force generated in the engine 30 is output to the power transmission mechanism 32 via a crankshaft 31.

As shown in FIG. 1 and FIG. 2, the power transmission mechanism 32 is disposed between the engine 30 and the propulsion unit 33. The power transmission mechanism 32 transmits the rotational force generated in the engine 30 to the propulsion unit 33. As shown in FIG. 2, the power transmission mechanism 32 is preferably provided with a shift mechanism 34, a gear reduction mechanism 37, and a synchronized mechanism 38.

As shown in FIG. 1, the shift mechanism 34 is connected to the crankshaft 31 of the engine 30. As shown in FIG. 2, the shift mechanism 34 includes a transmission gear ratio change mechanism 35 and a shift position change mechanism 36.

The transmission gear ratio change mechanism 35 changes a transmission gear ratio between the engine 30 and the propulsion unit 33 between a high-speed transmission gear ratio (HIGH) and a low-speed transmission gear ratio (LOW). Here, the "high-speed transmission gear ratio" refers to a transmission gear ratio in which the ratio of the output side rotational speed to the input side rotational speed is relatively high. On the other hand, the "low-speed transmission gear ratio" refers to a transmission gear ratio in which the ratio of the output side rotational speed to the input side rotational speed is relatively low.

The shift position change mechanism 36 changes a shift position among forward, reverse, and neutral.

Further, as shown in FIG. 3, a shift position sensor 34*a* is disposed in the shift mechanism 34. An actual shift position of the shift mechanism 34 is detected by the shift position sensor 34*a*.

As shown in FIG. 2, the gear reduction mechanism 37 is disposed between the shift mechanism 34 and the propulsion unit 33. The gear reduction mechanism 37 transmits a rotational force from the shift mechanism 34 to the propulsion unit 33 by reducing the rotational speed.

The synchronized mechanism 38 is disposed between the gear reduction mechanism 37 and the propulsion unit 33. The synchronized mechanism 38 includes a bevel gear-set not shown in the drawing. The synchronized mechanism 38 transmits a rotational force from the gear reduction mechanism 37 to the propulsion unit 33 by changing a direction thereof.

Each structure of the transmission gear ratio change mechanism 35, the shift position change mechanism 36, the gear reduction mechanism 37, and the synchronized mechanism 38 is not particularly limited. The transmission gear ratio change mechanism 35, the shift position change mechanism 36, the gear reduction mechanism 37, and the synchronized mechanism 38 may be, for example, a transmission gear ratio change mechanism, a shift position change mechanism, a gear reduction mechanism, and synchronized mechanism of a conventional type.

The propulsion unit 33 is provided with a propeller shaft 40 and a propeller 41. The propeller shaft 40 transmits the rotational force from the synchronized mechanism 38 to the propeller 41. The propulsion unit 33 converts the rotational force generated in the engine 30 into a propulsive force.

As shown in FIG. 1, the propeller 41 preferably includes two propellers, for example, a first propeller 41*a* and a second propeller 41*b*. A spiraling direction of the first propeller 41*a* and a spiraling direction of the second propeller 41*b* are opposite directions to each other. When the rotational force output from the power transmission mechanism 32 is in a forward rotation direction, the first propeller 41*a* and the second propeller 41*b* rotate in opposite directions to each other, generating a propulsive force in a forward direction. Therefore, the shift position becomes forward. On the other hand, when the rotational force output from the power transmission mechanism 32 is in a reverse rotation direction, each of the first propeller 41*a* and the second propeller 41*b* rotates in a direction opposite to the forward direction. This generates a propulsive force in a reverse direction. Therefore, the shift position becomes reverse.

The propeller 41 may include a single propeller or three propellers or more.

As shown in FIG. 2 and FIG. 3, a control device 91 is disposed in the outboard motor 20. The control device 91 is arranged to control a shift position of the shift mechanism 34. The control device 91 is preferably provided with an ECU 86 and an actuator 70. The ECU 86 is provided with a CPU (central processing unit) 86*a* as an operation portion and a memory 86*b*. As shown in FIG. 3, the CPU 86*a* is provided with a calculation portion 86*c* and an update portion 86*d*. The memory 86*b* stores various settings and the like described below such as allowable maximum voltage ($V_{seh}$), allowable minimum voltage ($V_{scl}$), reference voltage ($V_{sc}$), predetermined voltage (K), reverse voltage ($V_{sr}$), forward voltage ($V_{sf}$), and predetermined change limit value (Y). The memory 86*b* is connected to the CPU 86*a*. When the CPU 86*a* performs various calculations, the CPU 86*a* reads out necessary information stored in the memory 86*b*. Further, as necessary, the CPU 86*a* outputs calculation results to the memory 86*b* to make the memory 86*b* store the calculation results and so forth.

The ECU 86 controls the actuator 70. The actuator 70 drives the transmission gear ratio change mechanism 35 and the shift position change mechanism 36 of the shift mechanism 34. As a result, a transmission gear ratio and a shift position are changed.

The actuator is not particularly limited in the present preferred embodiment. The actuator may include, for example, an oil pump and a valve.

Accelerator Opening Detection Section 45

As shown in FIG. 3, the accelerator opening detection section 45 and the shift position detection mechanism 50 are disposed in the outboard motor 20.

The accelerator opening detection section 45 is connected to the control lever 83 by a wire 47. The accelerator opening detection section 45 is provided with an accelerator opening sensor 46. As the control lever 83 is operated by the operator to a position corresponding to a desired accelerator opening, the wire 47 moves. The accelerator opening sensor 46 detects an amount of movement of the wire 47 directly or indirectly. The accelerator opening sensor 46 outputs the detected amount of movement of the wire 47 as an accelerator opening signal to the ECU 86. The ECU 86 controls the throttle body 87 to set a throttle opening corresponding to the inputted accelerator opening signal. As a result, an output of the engine 30 is controlled.

Structure of the Shift Position Detection Mechanism 50

Figure 4:
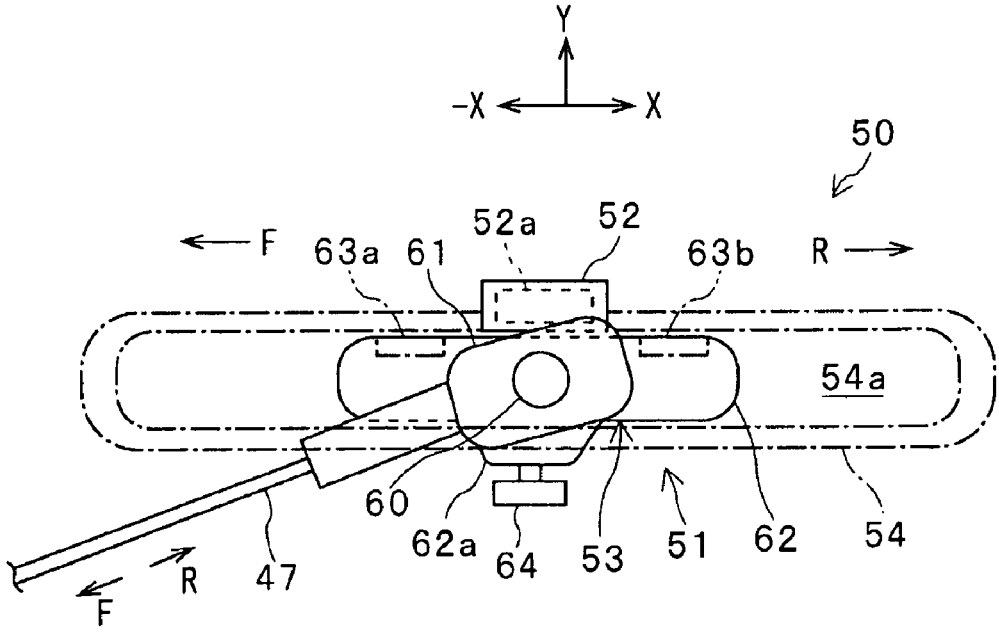
FIG. 4 is a schematic side view of a shift position detection mechanism.
Figure 5:
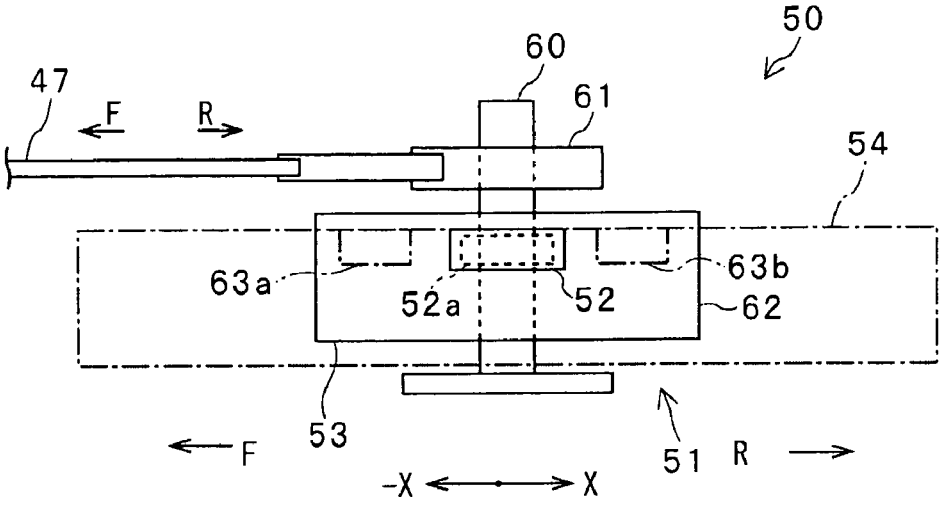
FIG. 5 is a schematic plan view of the shift position detection mechanism.

The shift position detection mechanism 50 is a mechanism that detects a shift position input by the operator in response to an operation position of the control lever 83. As shown in FIG. 3, FIG. 4, and FIG. 5, the shift position detection mechanism 50 is preferably provided with a slide mechanism 51 and a position detection section 52.

As shown in FIG. 4 and FIG. 5, the slide mechanism 51 is provided with a slider 53 as a detected member and a frame body 54. The frame body 54 is preferably in the shape of a loop in a side view. A slide space 54*a* having a narrow, longitudinal shape is provided in the frame body 54. The slider 53 is disposed in the slide space 54*a* of the frame body 54 to be slidable in the slide space 54*a*.

The slider 53 is provided with a slider main body 62, a shaft 60, a connecting member 61, and two magnetic materials 63*a*, 63*b*. The slider main body 62 is disposed in the slide space 54*a* and can slide in the slide space 54*a* in a direction in which the slide space 54*a* extends. The shaft 60 is mounted on the slider main body 62. The shaft 60 extends in a direction substantially orthogonal to a displacement direction of the slider main body 62; that is, in a direction of an opening of the frame body 54. The connecting member 61 is attached to an end portion of the shaft 60. The wire 47 is connected to the connecting member 61.

As described above, the slider 53 and the control lever 83 are connected by the wire 47. Therefore, when the control lever 83 is operated by the operator to a position corresponding to a desired shift position, as the control lever 83 causes displacement, the slider 53 is displaced to a position corresponding to the operation position of the control lever 83 in the frame body 54.

Specifically, when the control lever 83 is located in the middle position shown in FIG. 6 in the present preferred embodiment, the slider 53 is located generally at the center in the slide space 54*a*. As shown in FIG. 4 and FIG. 5, when the control lever 83 is operated from the neutral area to the forward area, the wire 47 is pulled. As a result, the slider 53 is displaced in the slide space 54*a* in a direction of −X (left direction) as shown in FIG. 4 and FIG. 5. On the other hand, when the control lever 83 is operated from the neutral area to the reverse area, the wire 47 is pushed out. As a result, the slider 53 is displaced in the slide space 54*a* in a direction of X (right direction) as shown in FIG. 4. An amount of movement of the wire 47 is proportional to the operation angle θ. Accordingly, as the operation angle θ becomes larger, an amount of movement of the wire 47 and an amount of displacement of the slider main body 62 become larger.

In the description below, a position of the slider 53 in which the control lever 83 is located in the middle position shown in FIG. 6 will be referred to as a "neutral position" of the slider 53.

The two magnetic materials, which are a first magnetic material 63*a* and a second magnetic material 63*b*, are embedded in the slider main body 62. The first magnetic material 63*a* and the second magnetic material 63*b* have polarities opposite to each other. Specifically, in the present preferred embodiment, the first magnetic material 63*a* has a magnetism that increases a voltage of a shift position signal output from the position detection section 52 described below. On the other hand, the second magnetic material 63*b* has a magnetism that decreases the voltage of a shift position signal output from the position detection section 52. The first magnetic material 63*a* is disposed on a side of −X shown in FIG. 4 with respect to the center of the slider main body 62 in the displacement direction of the slider main body 62. The second magnetic material 63*b* is disposed on a side of X shown in FIG. 4 with respect to the center of the slider main body 62 in the displacement direction of the slider main body 62. The magnetic materials 63*a*, 63*b* may be, for example, a permanent magnet and an electromagnet.

The position detection section 52 is attached on the frame body 54. As shown in FIG. 3 to FIG. 5, the position detection section 52 is provided with a magnetic sensor 52*a*. The magnetic sensor 52*a* detects a level and a polarity of magnetism and outputs a voltage of a polarity and a level corresponding to the polarity and the level of the detected magnetism as a shift position signal to the control device 91 shown in FIG. 3.

As shown in FIG. 4 and FIG. 5, the position detection section 52 is disposed generally at the center of the frame body 54 in the displacement direction of the slider 53. Specifically, the position detection section 52 is disposed practically in the same position as a center portion of the slider 53 located in the neutral position in the displacement direction of the slider main body 62. As shown in FIG. 4 and FIG. 5, the position detection section 52 is located generally at the center between the first magnetic material 63*a* and the second magnetic material 63*b* in the displacement direction of the slider main body 62 at the time when the control lever 83 is located in the middle position shown in FIG. 6.

Further, as shown in FIG. 4, a protrusion 62*a* is provided on the slider main body 62. On the other hand, a neutral sensor 64 is attached on the frame body 54. The neutral sensor 64 detects a position of the protrusion 62*a* to determine whether or not the control lever 83 shown in FIG. 6 is in a middle position in the neutral area (N). When the control lever 83 is located in the neutral area (N) shown in FIG. 6, the neutral sensor 64 outputs an ON signal. On the other hand, when the control lever 83 is located in the forward area (F) or in the reverse area (R) other than the neutral area (N) shown in FIG. 6, the neutral sensor 64 outputs an OFF signal.

Detection Principle of a Shift Position in the Shift Position Detection Mechanism 50

A detection principle of a shift position in the shift position detection mechanism 50 will be described in detail with reference to FIG. 4 to FIG. 7.

Firstly, a description will be given about a change in a shift position signal output from the position detection section 52 on an occasion where the control lever 83 is operated from the middle position to the forward area shown in FIG. 6. As described above, when the control lever 83 is located in the middle position, the position detection section 52 is disposed generally at the center between the first magnetic material 63*a* and the second magnetic material 63*b* in the displacement direction of the slider main body 62. Voltage of a shift position signal output from the position detection section 52 in this state is defined as a reference voltage ($V_{sc}$). The reference voltage ($V_{sc}$) also varies according to individual specificity of the outboard motor 20. Further, the reference voltage ($V_{sc}$) varies according to temperature of the position detection section 52. Therefore, the reference voltage ($V_{sc}$) is not necessarily constant.

As the control lever 83 is operated from the middle position toward a side of the forward area, the wire 47 is pulled. This causes the slider 53 to move in a direction of −X shown in FIG. 4 and FIG. 5. As the slider 53 moves in the direction of −X, the second magnetic material 63*b* comes closer to the position detection section 52. Therefore, a level of magnetism detected by the position detection section 52 becomes larger. Consequently, the operation angle θ is increased. As the second magnetic material 63*b* comes closer to the position detection section 52, the absolute value of a difference between the voltage of a shift position signal output from the position detection section 52 and the reference voltage ($V_{sc}$) becomes larger. Specifically, in the present preferred embodiment, as the operation angle θ is increased, and as the second magnetic material 63*b* comes closer to the position detection section 52, the voltage of a shift position signal output from the position detection section 52 becomes less than the reference voltage ($V_{sc}$).

Figure 7:
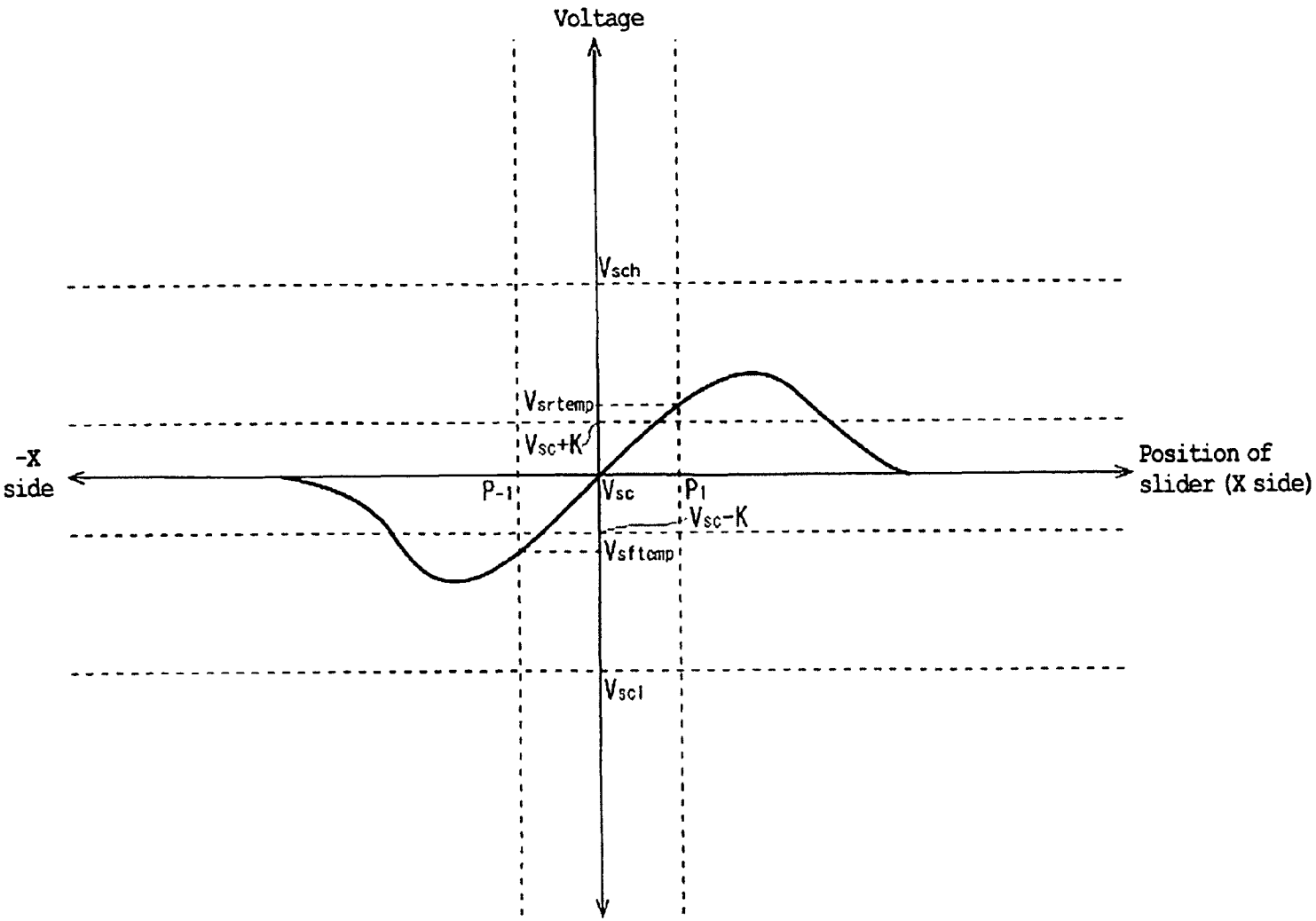
FIG. 7 is a graph showing a shift position signal output from a position detection section.

Specifically, the voltage of a shift position signal output from the position detection section 52 becomes smaller as the slider 53 moves until the second magnetic material 63*b* overlaps the position detection section 52 in the direction of X. On the other hand, the slider 53 further moves in the direction of −X, and the second magnetic material 63*b* is further displaced in the direction of −X beyond the position detection section 52. Then, as the slider 53 moves in the direction of −X, the second magnetic material 63*b* is spaced away from the position detection section 52. Therefore, as shown in FIG. 7, the voltage of a shift position signal output from the position detection section 52 becomes larger and then becomes closer to zero.

Next, a description will be given about a change in a shift position signal output from the position detection section 52 in which the control lever 83 is operated from the middle position to the reverse area shown in FIG. 6. As the control lever 83 is operated from the middle position toward a side of the reverse area, the wire 47 is pushed out. This causes the slider 53 to move in the direction of X shown in FIG. 4 and FIG. 5. As the slider 53 moves in the direction of X, the first magnetic material 63*a* comes closer to the position detection section 52. Therefore, a level of magnetism detected by the position detection section 52 becomes larger. Therefore, as the operation angle θ is increased, and as the first magnetic material 63*a* comes closer to the position detection section 52, the absolute value of a difference between the voltage of a shift position signal output from the position detection section 52 and the reference voltage (Vsc) becomes larger. Specifically, in the present preferred embodiment, as the operation angle θ is increased, and as the first magnetic material 63*a* comes closer to the position detection section 52, the voltage of a shift position signal output from the position detection section 52 becomes greater than the reference voltage ($V_{sc}$).

Specifically, the voltage of a shift position signal output from the position detection section 52 becomes larger as the slider 53 moves until the first magnetic material 63*a* overlaps the position detection section 52 in the direction of X. On the other hand, the slider 53 further moves in the direction of X, and the first magnetic material 63*a* is further displaced in the direction of X beyond the position detection section 52. Then, as the slider 53 moves in the direction of X, the first magnetic material 63*a* is spaced away from the position detection section 52. Therefore, as shown in FIG. 7, the voltage of a shift position signal output from the position detection section 52 becomes smaller and then becomes closer to zero.

The reference voltage ($V_{sc}$) may not necessarily be 0V. The reference voltage ($V_{sc}$) may be greater than 0V or may be less than 0V. The reference voltage ($V_{sc}$) may be, for example, about 2.5V. Further, in the present preferred embodiment, a description will be given about an example in which the voltage of a shift position signal becomes smaller as the second magnetic material 63*b* comes closer to the position detection section 52 while the voltage of a shift position signal becomes higher as the first magnetic material 63*a* comes closer to the position detection section 52. However, the present invention is not limited to this example. For example, the first and the second magnetic materials 63*a*, 63*b* and the position detection section 52 may be set such that the voltage of a shift position signal becomes higher as the second magnetic material 63*b* comes closer to the position detection section 52 while voltage of a shift position signal becomes less as the first magnetic material 63*a* comes closer to the position detection section 52.

As a shift position signal from the position detection section 52 and an output signal from the neutral sensor 64 are input to the ECU 86, a shift position is detected in the outboard motor 20.

Specifically, while the control lever 83 is located in the neutral area shown in FIG. 6, when an ON signal is output from the neutral sensor 64 to the ECU 86, then the shift position of the shift mechanism 34 is maintained to be neutral by the ECU 86 regardless of the voltage of a shift position signal output from the position detection section 52.

As the operator operates the control lever 83 from the neutral area to the forward area shown in FIG. 6, the slider 53 moves in the direction of −X shown in FIG. 4. Then, the neutral sensor 64 is turned off. As a result, an OFF signal is output from the neutral sensor 64. In this case, a shift change is performed based on a shift position signal from the position detection section 52.

Specifically, when the voltage of a shift position signal becomes higher than the reference voltage ($V_{sc}$) by a first predetermined value or becomes lower than the reference voltage ($V_{sc}$) by a second predetermined value, a shift change is performed from neutral to forward or reverse. In the present preferred embodiment, when the voltage of a shift position signal becomes lower than the reference voltage ($V_{sc}$) by the second predetermined value, a shift change is performed from neutral to forward. Further, when the voltage of a shift position signal becomes higher than the reference voltage (Vsc) by the first predetermined value, a shift change is performed from neutral to reverse.

In the present preferred embodiment, a description will be provided of an example where the first predetermined value and the second predetermined value are at the same predetermined voltage (K). However, the first predetermined value and the second predetermined value may be different from each other.

Specifically, in the present preferred embodiment, while the slider 53 moves from a position $P_{-1}$, where the neutral sensor 64 is turned off, further in the direction of −X, when the voltage of a shift position signal from the position detection section 52 becomes less than a predetermined voltage ($V_{SC}$−K), the ECU 86 enables the actuator 70 to change a shift position to forward. In the case shown in FIG. 7, when the slider 53 reaches the position $P_{-1}$, the voltage of a shift position signal from the position detection section 52 becomes less than the predetermined voltage ($V_{SC}$−K). Therefore, when the slider 53 reaches the position $P_{-1}$, a shift change is performed from neutral to forward.

On the other hand, if the operator operates the control lever 83 from the forward area to the neutral area, when a position of the slider 53 reaches the position $P_{-1}$, the neutral sensor 64 is turned on. As a result, a shift change from forward to neutral is performed.

On the other hand, as the operator operates the control lever 83 from the neutral area to the reverse area shown in FIG. 6, when the slider 53 moves in the direction of X shown in FIG. 4, the neutral sensor 64 is turned off. As a result, an OFF signal is output from the neutral sensor 64. In this case, a shift change is performed based on a shift position signal from the position detection section 52. Specifically, while the slider 53 moves from a position $P_1$, where the neutral sensor 64 is turned off, further in the direction of X, when the voltage of a shift position signal from the position detection section 52 becomes equal to or greater than a predetermined voltage ($V_{SC}$+K), the ECU 86 enables the actuator 70 to change a shift position from neutral to reverse. In the case shown in FIG. 7, when the slider 53 reaches the position $P_1$, voltage of a shift position signal from the position detection section 52 becomes equal to or greater than the predetermined voltage ($V_{SC}$+K). Therefore, when the slider 53 reaches the position $P_1$, the shift change is performed to reverse.

On the other hand, if the operator operates the control lever 83 from the reverse area to the neutral area, when a position of the slider 53 reaches the position $P_1$, the neutral sensor 64 is turned on. As a result, a shift change is performed from forward to neutral.

In the present preferred embodiment, a description is given about the example where a shift change to neutral is performed according to the neutral sensor 64. However, the neutral sensor 64 is not indispensable in the present invention. For example, a shift position may be controlled solely on the basis of a shift position signal output from the position detection section 52 without the neutral sensor 64.

Shift Change Control

Specific content of a shift change feedback control of the control device 91 will be described hereinafter in further detail with reference to mainly FIG. 7 to FIG. 11.

Firstly, in step S1, the ECU 86 shown in FIG. 2 determines whether or not the voltage ($V_s$) of a shift position signal output from the position detection section 52 is equal to or less than the allowable maximum voltage ($V_{seh}$) or equal to or greater than the allowable minimum voltage ($V_{scl}$) shown in FIG. 7.

If it is determined in step S1 that the shift position signal voltage ($V_s$) is greater than the allowable maximum voltage ($V_{seh}$) or less than the allowable minimum voltage ($V_{scl}$), the procedure goes to step S12. On the other hand, if it is determined in step S1 that the shift position signal voltage ($V_s$) is equal to or less than the allowable maximum voltage ($V_{seh}$) or equal to or greater than the allowable minimum voltage ($V_{scl}$), the procedure goes to step S2.

It is determined by the ECU 86 in step S2 whether or not the neutral sensor 64 is in an off state. Specifically, it is determined by the ECU 86 that a signal output from the neutral sensor 64 is an ON signal or an OFF signal. If the signal output from the neutral sensor 64 is an ON signal, the procedure goes to step S6. In other words, when the control lever 83 and the slider 53 are in the neutral area, the procedure goes to step S6 in principle.

However, even when the control lever 83 and the slider 53 is in the forward area or in the reverse area, if an abnormality occurs in the neutral sensor 64, the procedure may go to step S6.

It is determined by the ECU 86 in step S6 whether or not the accelerator opening detected by the accelerator opening sensor 46 shown in FIG. 3 is equal to or smaller than a first threshold. If it is determined in step S6 that the accelerator opening is equal to or smaller than the first threshold, the procedure goes to step S10. On the other hand, if it is determined in step S6 that the accelerator opening is larger than the first threshold, the procedure goes to step S11.

If a signal output from the neutral sensor 64 is an OFF signal in step S2, the procedure goes to step S3. In other words, when the control lever 83 and the slider 53 are in the forward area or in the reverse area, the procedure goes to step S3 in principle.

It is determined based on a detection result of the shift position sensor 34*a* by the ECU 86 in step S3 whether or not the actual shift position of the shift mechanism 34 is neutral. When the actual shift position of the shift mechanism 34 in step S3 is not neutral but forward or reverse, the procedure ends. On the other hand, when it is determined that the actual shift position of the shift mechanism 34 is neutral, the procedure goes to step S4.

It is determined by the ECU 86 in step S4 whether or not the shift position signal voltage ($V_s$) is less than the reference voltage ($V_{sc}$) by the second predetermined value or larger. Specifically, in the present preferred embodiment, the second predetermined value is the voltage (K). Therefore, it is determined by the ECU 86 in step S4 whether or not the shift position signal voltage ($V_s$) is equal to or less than a voltage obtained by subtracting the predetermined voltage (K) from the reference voltage ($V_{sc}$).

The allowable maximum voltage ($V_{seh}$), the allowable minimum voltage ($V_{scl}$), and the predetermined voltage (K)

can be appropriately set in consideration of characteristics of the outboard motor 20. For example, if a shift position sensor 34*a* is used within the range from 0 to 5V, the settings listed below may be provided. However, the values listed below are nothing more than examples. The present invention is not limited at all by the values listed below.

Allowable maximum voltage ($V_{seh}$): 4.5V

Reference voltage ($V_{sc}$): 2.5V

Voltage (K): 0.3V

Allowable minimum voltage ($V_{scl}$): 0.5V

If it is determined in step S4 that $V_{sc}-K<V_s$, the procedure goes to step S7. On the other hand, if it is determined that $V_{sc}-K\geqq V_s$, the procedure goes to step S5.

A shift change of a shift position of the shift mechanism 34 shown in FIG. 2 is performed by the control device 91 in step S5 from neutral to forward. Specifically, the ECU 86 enables the actuator 70 to perform a shift change of the shift position of the shift mechanism 34 from neutral to forward. When the shift mechanism 34 is in neutral, the shift mechanism 34 is disengaged in step S4. If there is a clutch for forward connection that is engaged in the case of forward, a connection force of the clutch for forward connection may be increased to engage the clutch for forward connection. In this manner, a shift change can be smoothly performed from neutral to forward.

Figure 9:
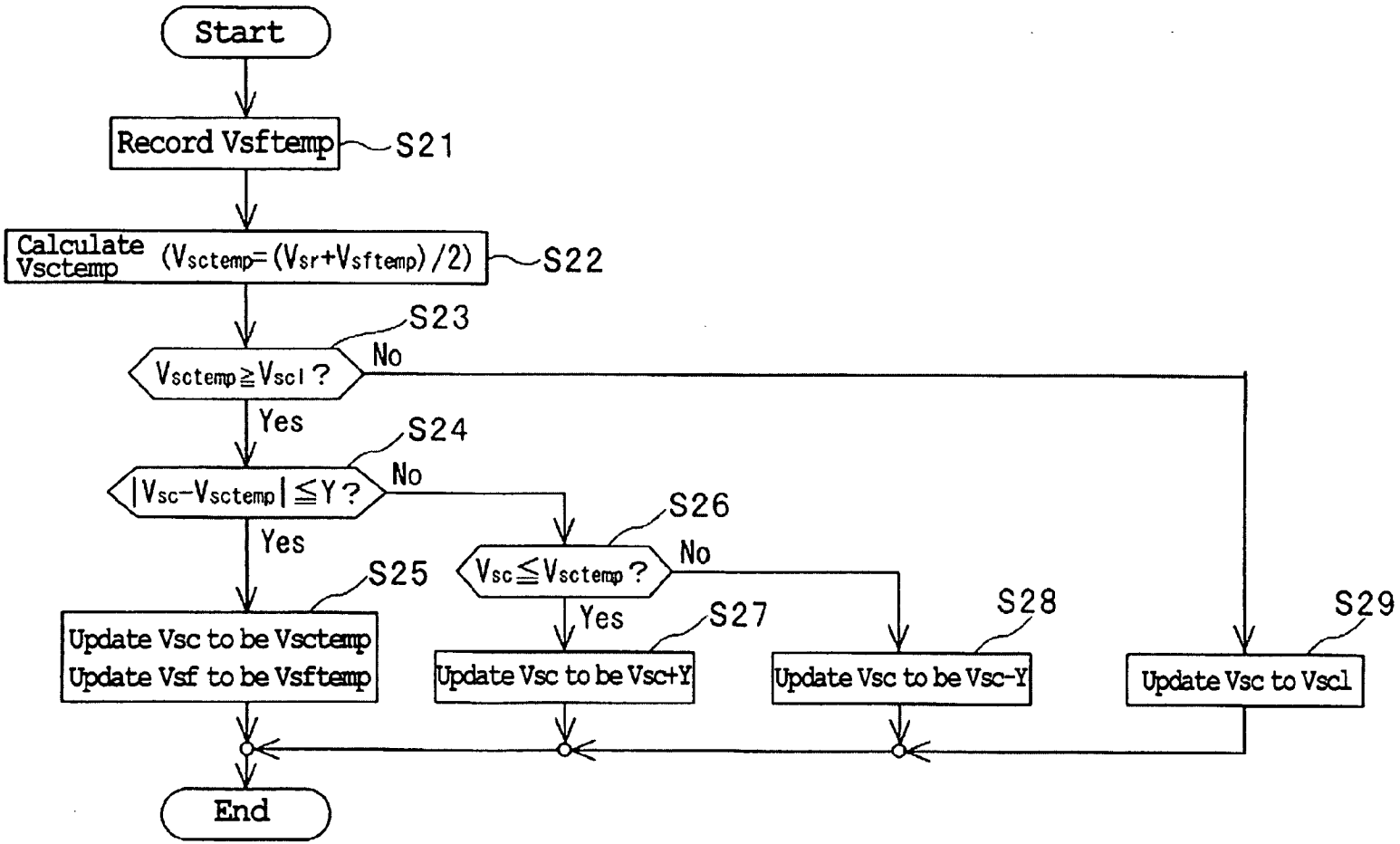
FIG. 9 is a flow chart showing update control of a neutral median in step S20.

After step S5, step S20, whose details are shown in FIG. 9, is started.

On the other hand, it is determined by the ECU 86 in step S7 whether or not the shift position signal voltage ($V_s$) is greater than the reference voltage ($V_{sc}$) by the first predetermined value or larger. Specifically, in the present preferred embodiment, the first predetermined value is the voltage (K). Therefore, it is determined by the ECU 86 in step S7 whether or not the shift position signal voltage ($V_s$) is equal to or greater than the voltage obtained by adding the predetermined voltage (K) to the reference voltage ($V_{sc}$). If it is determined in step S7 that $V_{sc}+K>V_s$, the procedure goes to step S9. On the other hand, if it is determined that $V_{sc}+K\leqq V_s$, the procedure goes to step S8.

A shift change of the shift position of the shift mechanism 34 shown in FIG. 2 is performed by the control device 91 in step S8 from neutral to reverse. Specifically, the ECU 86 enables the actuator 70 to perform a shift change of the shift position of the shift mechanism 34 from neutral to reverse. When the shift mechanism 34 is neutral, the shift mechanism 34 is disengaged in step S8. If there is a clutch for reverse connection that is engaged in the case of reverse, a connection force of the clutch for reverse connection maybe increased to engage the clutch for reverse connection. In this manner, a shift change can be smoothly performed from neutral to reverse.

Figure 10:
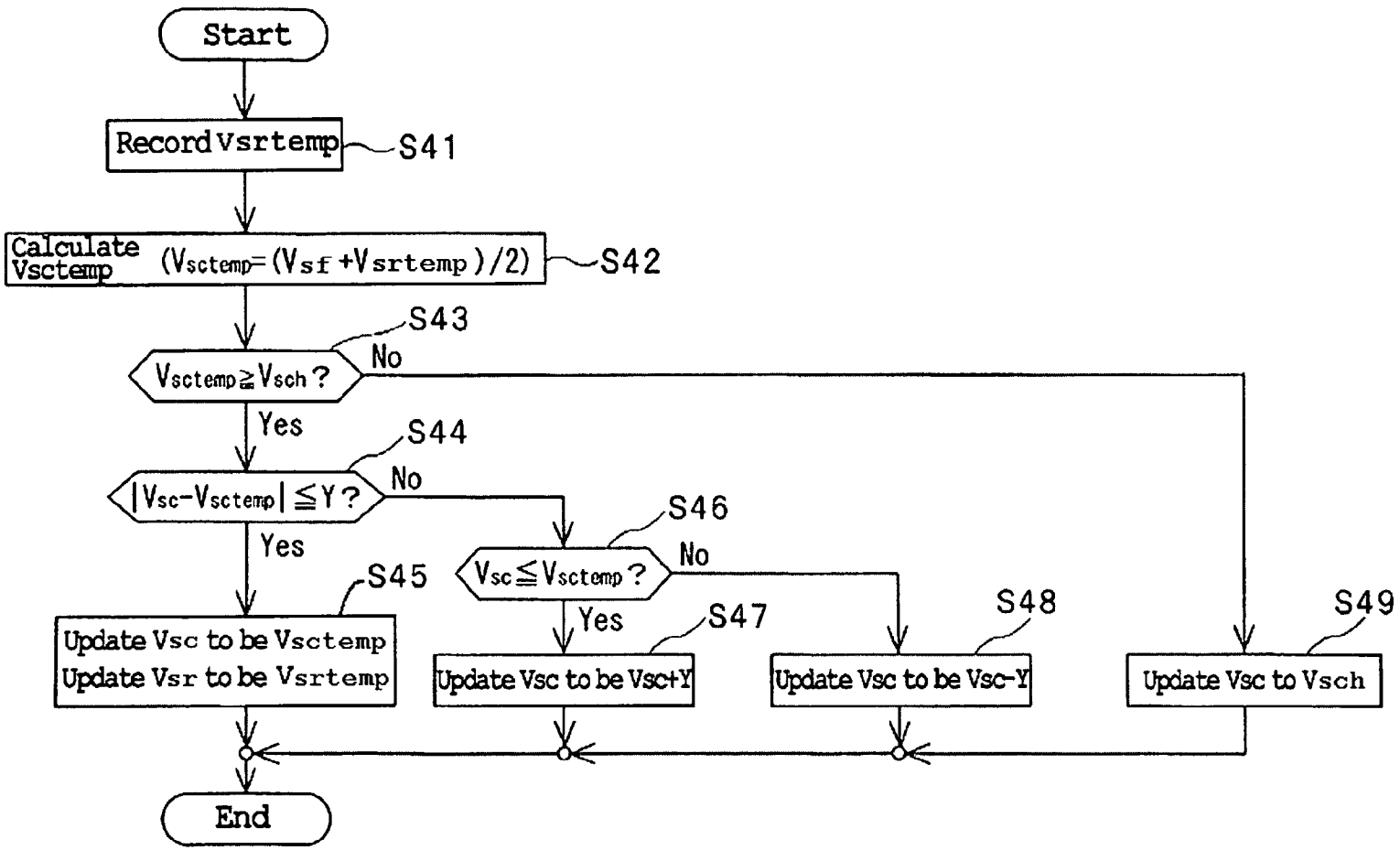
FIG. 10 is a flow chart showing update control of a neutral median in step S40.

After step S8, step S40, whose details are shown in FIG. 10, is started.

It is determined by the ECU 86 in step S9 whether or not the accelerator opening detected by the accelerator opening sensor 46 shown in FIG. 3 is equal to or less than the first threshold. If it is determined in step S9 that the accelerator opening is larger than the first threshold, the procedure goes to step S12. On the other hand, if it is determined in step S9 that the accelerator opening is equal to or smaller than the first threshold, the procedure goes to step S10. In step S10, the shift position of the shift mechanism 34 shown in FIG. 2 is maintained to be neutral.

The "first threshold" of the accelerator opening in step S6 and in step S9 can be appropriately set according to characteristics of the outboard motor 20. The "first threshold" of the accelerator opening in step S6 and in step S9 can be set, for example, to about 5 degrees to about 20 degrees.

As described above, if it is determined in step S1 that the shift position signal voltage ($V_s$) is greater than the allowable maximum voltage ($V_{seh}$) or less than the allowable minimum voltage ($V_{scl}$), the procedure goes to step S12. In addition, if it is determined in step S9 that the accelerator opening is larger than the first threshold, the procedure goes to step S12.

In step S12, an abnormality of the position detection section 52 is detected, and, at the same time, a warning against the abnormality of the position detection section 52 is given.

In addition, as described above, if it is determined in step S6 that the accelerator opening is larger than the first threshold, the procedure goes to step S11. In step S11, an abnormality of the neutral sensor 64 is detected, and, at the same time, a warning against the abnormality of the neutral sensor 64 is given.

A method of warning against an abnormality in step S12 or in step S11 is not particularly limited. For example, a warning sound or a warning announcement may be given by a buzzer or the like, or a warning light may be flashed. Further, a warning may be displayed on a display device provided to the boat 1.

After step S11 and step S12, step S13 is started. It is determined in step S13 whether or not the accelerator opening detected by the accelerator opening sensor 46 shown in FIG. 3 is equal to or less than a second threshold. If it is determined in step S13 that the accelerator opening is smaller than the second threshold, the procedure goes to step S15.

The shift position of the shift mechanism 34 is maintained to be neutral in step S15. Accordingly, for example, when an abnormality of the neutral sensor 64 or the position detection section 52 is detected, if the accelerator opening detected by the accelerator opening sensor 46 shown in FIG. 3 is less than the second threshold, neutral is maintained. If the accelerator opening detected by the accelerator opening sensor 46 is equal to or greater than the second threshold, a shift change is performed to forward. At the same time, a restriction control of the throttle opening is performed.

On the other hand, if it is determined in step S13 that the accelerator opening is equal to or larger than the second threshold, the procedure goes to step S14.

In step S14, a shift change of the shift position of the shift mechanism 34 shown in FIG. 2 is performed from neutral to forward, and, at the same time, output restriction of the engine 30 as a power source is performed by a restriction control of the throttle opening. Here, restriction control of the throttle opening refers to a control shown with a solid line in FIG. 11 in which the throttle opening with respect to the accelerator opening is controlled to be smaller compared to the normal throttle opening with respect to the accelerator opening shown with an alternate long and short broken line in FIG. 11.

Figure 11:
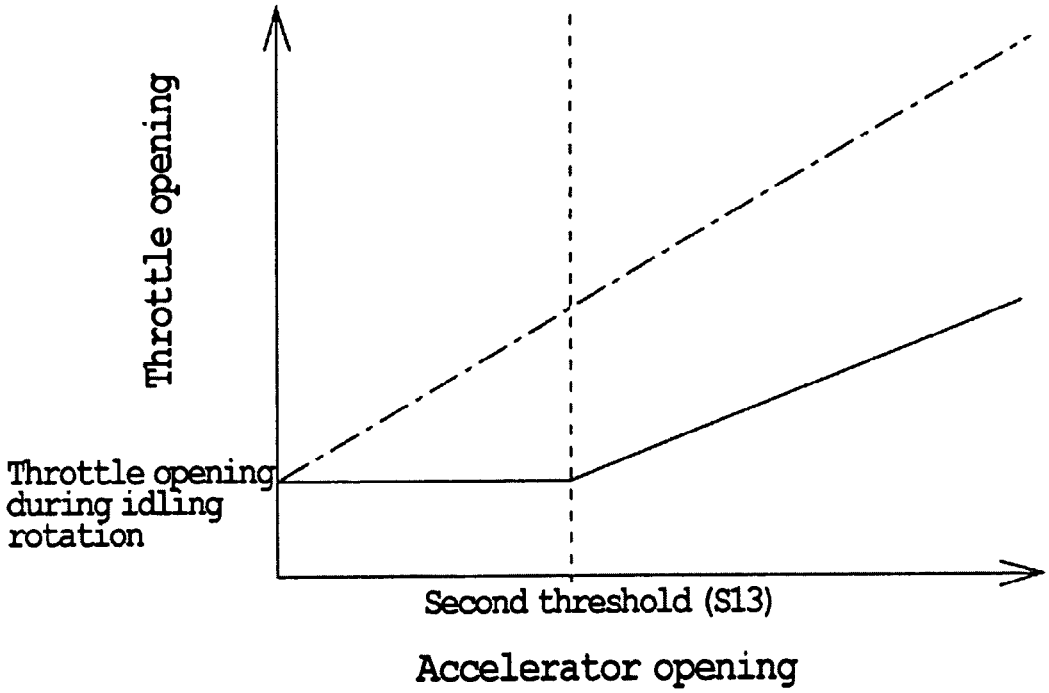
FIG. 11 is a map showing a relationship between the throttle opening and the accelerator opening in the case where an abnormality is determined in the position detection section. A graph shown with a solid line in FIG. 11 shows the relationship between the throttle opening and the accelerator opening in the case where an abnormality is detected in the position detection section. A graph shown in FIG. 11 with an alternate long and short broken line shows the relationship between the throttle opening and the accelerator opening during normal time.

The "second threshold" of the accelerator opening in step S13 is as shown in FIG. 11. The "second threshold" of the accelerator opening in step S13 can be appropriately set according to characteristics of the outboard motor 20. The "second threshold" of the accelerator opening in step S13 is normally set to a value larger than the first threshold of the accelerator opening in step S6 and in step S9. The "second threshold" of the accelerator opening in step S13 can be set to a value larger than the first threshold; that is, for example, about 5 to about 50 degrees. For example, the first threshold may be about 10 degrees while the second threshold may be about 20 degrees.

Updating the Reference Voltage ($V_{sc}$)

A process for updating the reference voltage ($V_{sc}$) in step S20 will be described hereinafter in detail mainly with reference to FIG. 9.

As shown in FIG. 9, the CPU 86*a* shown in FIG. 3 stores the shift position signal voltage ($V_s$) at the time when a shift change is performed to forward in step S5 as a temporary forward voltage ($V_{sftemp}$) in the memory 86*b* in step S21.

After step S21, step S22 is started. In step S22, the calculation portion 86*c* of the CPU 86*a* shown in FIG. 3 calculates a temporary reference voltage ($V_{sctemp}$) as a possible update value of the reference voltage given by the expression $V_{sctemp}=(V_{sftemp}+V_{sr})/2$ from the temporary forward voltage ($V_{sftemp}$) and the reverse voltage ($V_{sr}$) stored in the memory 86*b*. The calculated temporary reference voltage ($V_{sctemp}$) is temporarily stored in the memory 86*b*.

Here, the reverse voltage ($V_{sr}$) refers to the voltage of the shift position signal output from the position detection section 52 when a shift position is changed from neutral to reverse. On the other hand, the forward voltage ($V_{sf}$) refers to the voltage of the shift position signal output from the position detection section 52 when a shift position is changed from neutral to forward.

After step S22, step S23 is started. It is determined whether or not the calculated temporary reference voltage ($V_{sctemp}$) is equal to or greater than the allowable minimum voltage ($V_{scl}$) by the update portion 86*d* of the CPU 86*a* in step S23. If it is determined in step S23 that the temporary reference voltage ($V_{sctemp}$) is less than the allowable minimum voltage ($V_{scl}$), the procedure goes to step S29. Further, the reference voltage ($V_{sc}$) stored in the memory 86*b* is updated to be the allowable minimum voltage ($V_{scl}$) by the update portion 86*d* of the CPU 86*a* in step S29.

On the other hand, if it is determined in step S23 that the temporary reference voltage ($V_{sctemp}$) is equal to or greater than the allowable minimum voltage ($V_{scl}$), the procedure goes to step S24. It is determined in step S24 whether or not the absolute value of the voltage obtained by subtracting the temporary reference voltage ($V_{sctemp}$) calculated in step S22 from the reference voltage ($V_{sc}$) stored in the memory 86*b* is equal to or less than the predetermined change limit value (Y). If it is determined in step S24 that $|V_{sc}-V_{sctemp}|\leqq Y$, the procedure goes to step S25.

The reference voltage ($V_{sc}$) stored in the memory 86*b* is updated to be the temporary reference voltage ($V_{sctemp}$) by the update portion 86*d* of the CPU 86*a* in step S25. At the same time, the forward voltage ($V_{sf}$) is updated to be the temporary forward voltage ($V_{sftemp}$).

On the other hand, if it is determined in step S24 that $|V_{sc}-V_{sctemp}|>Y$, the procedure goes to step S26. It is determined in step S26 whether or not the reference voltage ($V_{sc}$) is equal to or less than the temporary reference voltage ($V_{sctemp}$). If it is determined in step S26 that the reference voltage ($V_{sc}$) is equal to or less than the temporary reference voltage ($V_{sctemp}$), the procedure goes to step S27.

The reference voltage ($V_{sc}$) stored in the memory 86*b* is updated to be a voltage ($V_{sc}+Y$) obtained by adding a change limit value (Y) to the reference voltage ($V_{sc}$) by the update portion 86*d* of the CPU 86*a* in step S27.

On the other hand, if it is determined in step S26 that the reference voltage (Vsc) is greater than the temporary reference voltage ($V_{sctemp}$), the procedure goes to step S28. The reference voltage ($V_{sc}$) stored in the memory 86*b* is updated to be a voltage ($V_{sc}-Y$) obtained by subtracting the change limit value (Y) from the reference voltage ($V_{sc}$) by the update portion 86*d* of the CPU 86*a* in step S28.

A process for updating the reference voltage ($V_{sc}$) in step S40 will be described hereinafter in detail mainly with reference to FIG. 10.

As shown in FIG. 10, the CPU 86*a* shown in FIG. 3 stores the shift position signal voltage ($V_s$) at the time when a shift change is performed to reverse in step S8 as a temporary reverse voltage ($V_{srtemp}$) in the memory 86*b* in step S41.

After step S41, step S42 is started. In step S42, the calculation portion 86*c* of the CPU 86*a* shown in FIG. 3 calculates the temporary reference voltage ($V_{sctemp}$) as a possible update value of the reference voltage given by the expression $V_{sctemp}=(V_{srtemp}+V_{sf})/2$ from the temporary reverse voltage ($V_{srtemp}$) and the forward voltage ($V_{sf}$) stored in the memory 86*b*. The calculated temporary reference voltage ($V_{sctemp}$) is temporarily stored in the memory 86*b*.

After step S42, step S43 is started. It is determined in step S43 whether or not the calculated temporary reference voltage ($V_{sctemp}$) is equal to or greater than the allowable maximum voltage ($V_{sch}$) by the update portion 86*d* of the CPU 86*a*. If it is determined in step S43 that the temporary reference voltage ($V_{sctemp}$) is greater than the allowable maximum voltage ($V_{sch}$), the procedure goes to step S49. In step S49, the reference voltage ($V_{sc}$) stored in the memory 86*b* is updated to be the allowable maximum voltage ($V_{sch}$) by the update portion 86*d* of the CPU 86*a*.

On the other hand, if it is determined in step S43 that the temporary reference voltage ($V_{sctemp}$) is equal to or less than the allowable maximum voltage ($V_{sch}$), the procedure goes to step S44. It is determined in step S44 whether or not the absolute value of the voltage obtained by subtracting the temporary reference voltage ($V_{sctemp}$) calculated in step S42 from the reference voltage ($V_{sc}$) stored in the memory 86*b* is equal to or less than the predetermined change limit value (Y). If it is determined in step S44 that $|V_{sc}-V_{sctemp}|\leqq Y$, the procedure goes to step S45.

Instep S45, the reference voltage ($V_{sc}$) stored in the memory 86*b* is updated to be the temporary reference voltage ($V_{sctemp}$) by the update portion 86*d* of the CPU 86*a*, and at the same time, the reverse voltage ($V_{sr}$) is updated to be the temporary reverse voltage ($V_{srtemp}$).

On the other hand, if it is determined in step S44 that $|V_{sc}-V_{sctemp}|>Y$, the procedure goes to step S46. It is determined in step S46 whether or not the reference voltage ($V_{sc}$) is equal to or less than the temporary reference voltage ($V_{sctemp}$). If it is determined in step S46 that the reference voltage ($V_{sc}$) is equal to or less than the temporary reference voltage ($V_{sctemp}$), the procedure goes to step S47.

The reference voltage ($V_{sc}$) stored in the memory 86*b* is updated to be the voltage ($V_{sc}+Y$) obtained by adding the change limit value (Y) to the reference voltage ($V_{sc}$) by the update portion 86*d* of the CPU 86*a* in step S47.

On the other hand, if it is determined in step S46 that the reference voltage ($V_{sc}$) is greater than the temporary reference voltage ($V_{sctemp}$), the procedure goes to step S48. The reference voltage ($V_{sc}$) stored in the memory 86*b* is updated to be the voltage ($V_{sc}-Y$) obtained by subtracting the change limit value (Y) from the reference voltage ($V_{sc}$) by the update portion 86*d* of the CPU 86*a* in step S48.

As described above, the shift position detection mechanism 50 is preferably provided for the outboard motor 20 in the present preferred embodiment. Moreover, the shift position detection mechanism 50 is connected to the control lever 83 with the wire 47. Therefore, it is not necessary to provide expensive components such as a position sensor for shift position control on the controller 82. Therefore, it is possible to make the boat 1 less expensive.

Further, even when an outboard motor of a so-called mechanical type in which the control lever 83 and the shift mechanism 34 are directly connected by a wire is replaced by the outboard motor 20 of an electronic control type, it is possible to continue to use the controller 82 as it is. Therefore, it is possible to replace an outboard motor provided with a mechanical type shift mechanism with an outboard motor provided with a shift mechanism of an electronic control type to perform a transition to electronic control at low cost. In other words, it becomes possible to satisfy the need that an outboard motor of a so-called mechanical type is replaced with an outboard motor of an electronic control type at low cost.

In addition, the shift mechanism 34 is of an electronic control type. Accordingly, it is possible to control a shift position even more precisely compared to a shift mechanism of a mechanical type. Further, as described above, abnormality detection of the position detection section 52 and the neutral sensor 64 also becomes possible.

In the present preferred embodiment, the shift position detection mechanism 50 preferably uses the slider 53. Therefore, it is possible to reduce the cost of the shift position detection mechanism 50. In addition, it is possible to increase the number of common parts with the outboard motor 20 of a mechanical type. Therefore, it is also possible to reduce the cost of the outboard motor 20.

In the present preferred embodiment, it is determined in step S4 whether or not $V_{sc}-K \geqq V_s$, and it is determined in step S7 whether or not $V_{sc}+K \leqq V_s$. Moreover, if $V_{sc}-K<V_s$ and $V_{sc}+K>V_s$, a shift change is not performed to forward or to reverse in principle. In other words, if a change in the shift position signal voltage ($V_s$) is equal to or smaller than the predetermined voltage (K) with respect to the reference voltage ($V_{sc}$), a shift change is not performed to forward or to reverse in principle. Therefore, it is possible to surely perform a shift change to forward or to reverse only when the control lever 83 is moved to the forward area or to the reverse area.

The reference voltage ($V_{sc}$) is different according to individuality of the shift position detection mechanism 50. Further, the reference voltage ($V_{sc}$) varies according to the temperature of the shift position detection mechanism 50. On the other hand, the reference voltage ($V_{sc}$) in the present preferred embodiment is updated in a timely manner. Therefore, a more adequate reference voltage ($V_{sc}$) corresponding to the temperature and individual difference of the shift position detection mechanism 50 is used.

In the present preferred embodiment, a description is given of an example where update control of the reference voltage ($V_{sc}$) is preferably constantly performed while the outboard motor 20 operates. However, it is not necessary to constantly perform the update control of the reference voltage ($V_{sc}$) during an operation period of the outboard motor 20. For example, the update control may be performed only one time when the outboard motor 20 is started. The update control of the reference voltage ($V_{sc}$) may be performed at regular intervals while the outboard motor 20 operates. A switch for the update control of the reference voltage ($V_{sc}$) may be provided, and the update control of the reference voltage ($V_{sc}$) may be performed only when the switch is operated by the operator.

In the present preferred embodiment, as shown in FIG. 9 and in FIG. 10, when the temporary reference voltage ($V_{sctemp}$) is greater than the allowable maximum voltage ($V_{seh}$), or when the temporary reference voltage ($V_{sctemp}$) is less than the allowable minimum voltage ($V_{scl}$), the reference voltage ($V_{sc}$) stored in the memory 86*b* is updated to be the allowable maximum voltage ($V_{seh}$) or to be the allowable minimum voltage ($V_{scl}$). Therefore, it is possible to prevent the reference voltage ($V_{sc}$) from being greater than the allowable maximum voltage ($V_{seh}$) or being less than the allowable minimum voltage ($V_{scl}$).

Figure 8:
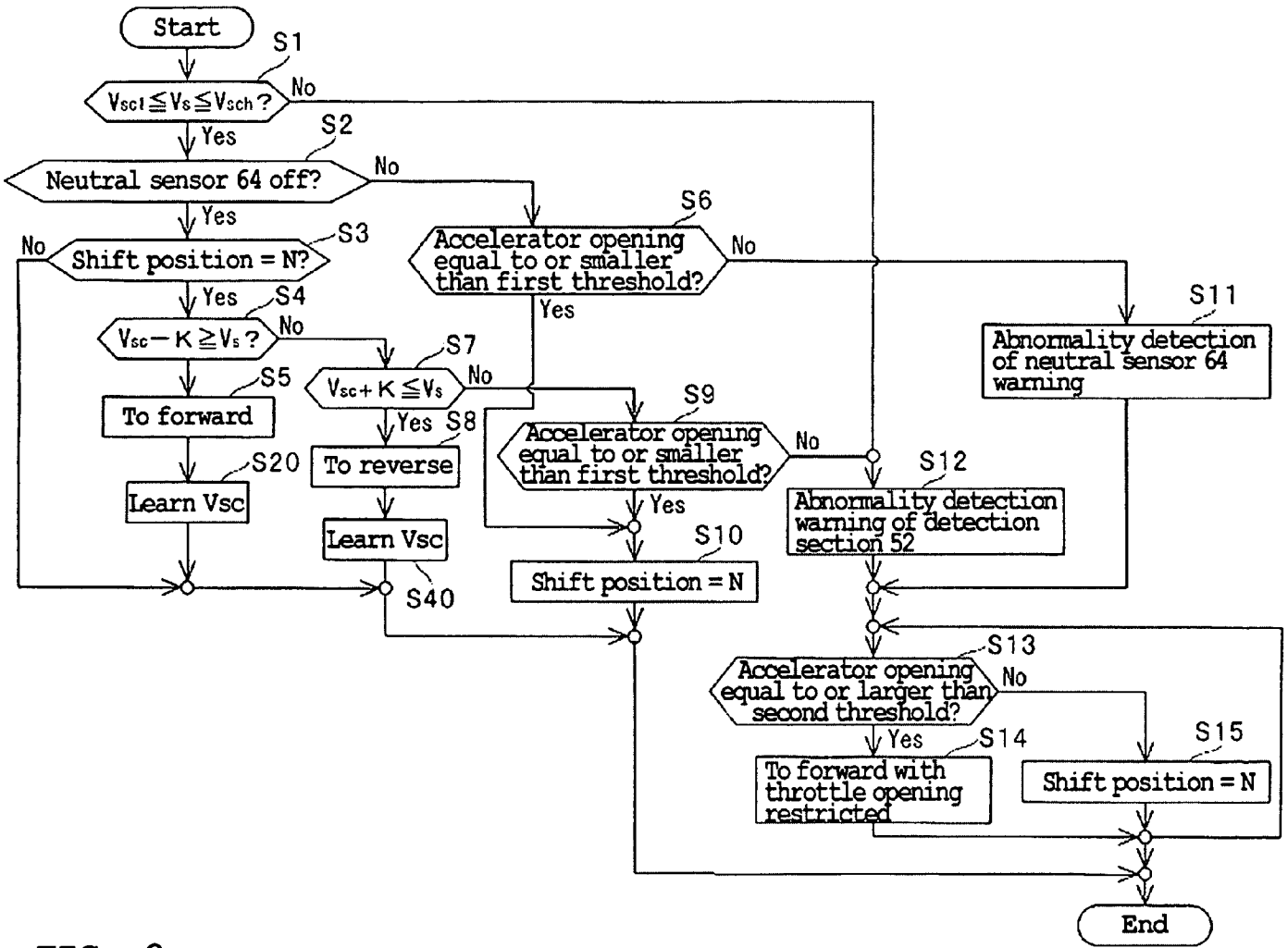
FIG. 8 is a flow chart showing a shift change control according to a preferred embodiment of the present invention.

In the present preferred embodiment, as shown in FIG. 8, it is determined in step S1 whether or not $V_{scl} \leqq V_s \leqq V_{seh}$. Moreover, if it is determined that $V_{scl}>V_s$ or $V_s>V_{seh}$, an abnormality of the position detection section 52 is detected, and, at the same time, the abnormality is reported in step S12. Therefore, abnormality detection of the position detection section 52 can be easily performed. In addition, an abnormality of the position detection section 52 can be promptly reported to the operator.

In the present preferred embodiment, abnormality detection of the outboard motor 20 is preferably performed based on an acceleration opening, a shift position signal, and at least one of an ON signal and an OFF signal from the neutral sensor 64. As the abnormality detection is performed based on a plurality of factors as described above, a more advanced abnormality detection becomes possible. For example, a more accurate detection of an abnormal position also becomes possible. Specifically, for example, abnormality detection of the neutral sensor 64, abnormality detection of the position detection section 52, and the like become possible.

Specifically, if the shift position signal voltage ($V_s$) is in the range of $V_{scl} \leqq V_s \leqq V_{seh}$ notwithstanding the fact that the accelerator opening is larger than the first threshold, an abnormality of the position detection section 52 is detected by step S4, step S7, and step S9 in FIG. 8. If the shift position signal voltage ($V_s$) is small notwithstanding the fact that the shift position signal voltage ($V_s$) ought to become high due to a large accelerator opening, it is recognized that an abnormality has occurred in the position detection section 52 that outputs a shift position signal. In the present preferred embodiment, the abnormality can be detected by step S4, step S7, and step S9.

Further, while an ON signal is not output from the neutral sensor 64 when the shift position of the shift mechanism 34 is not neutral, and if the shift position signal voltage ($V_s$) is low notwithstanding the fact that the accelerator opening is large, it is also recognized that an abnormality has occurred in the position detection section 52 that outputs a shift position signal. In the present preferred embodiment, the abnormality can be detected by, step S2, step S4, step S7, and step S9.

Moreover, if an ON signal is output from the neutral sensor 64 notwithstanding the fact that the accelerator opening is large, it is recognized that an abnormality has occurred in the neutral sensor 64. In the present preferred embodiment, the abnormality can be detected by step S2 and step 6.

In the present preferred embodiment, when an abnormality is detected, a shift change is performed to forward in step S14 with an output of the engine 30 restricted. Therefore, even if an abnormality is detected, it is possible to slowly move the boat 1.

Modified Examples

Figure 12:
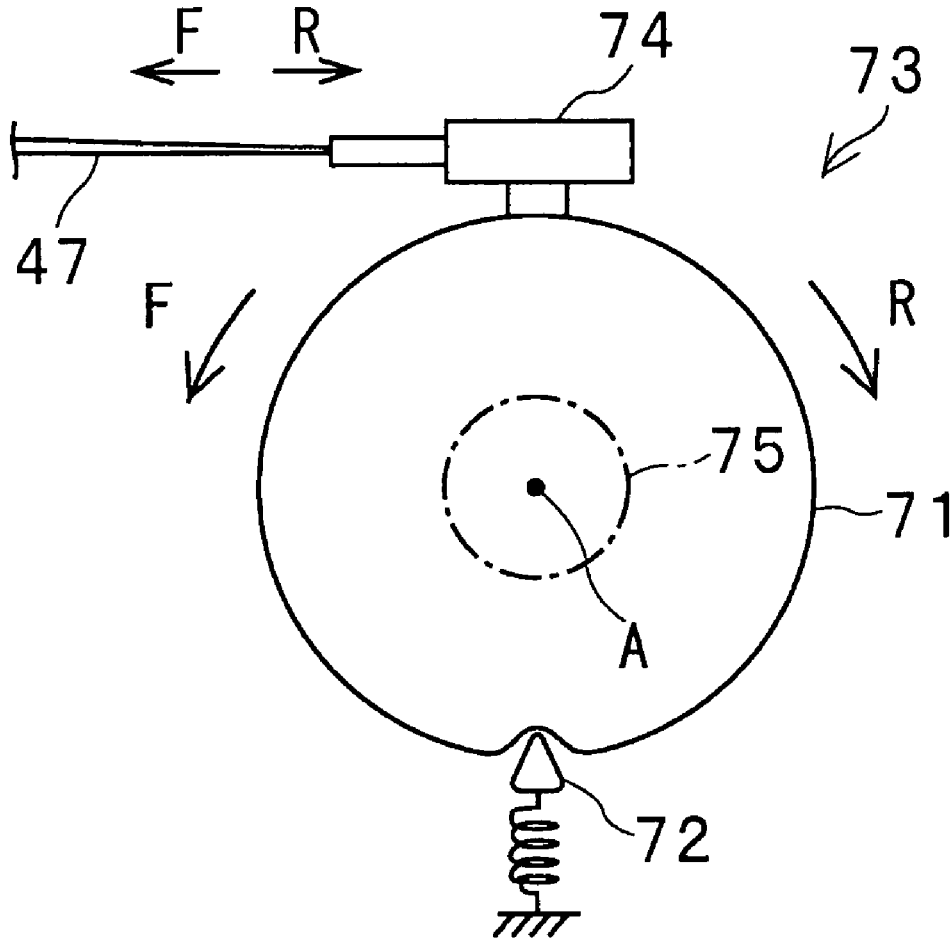
FIG. 12 is a schematic side view of a shift position detection mechanism according to a modified example.

In the preferred embodiments described above, as shown in FIG. 4 and FIG. 5, a description is provided of an example where the shift position detection mechanism 50 of a slide type is preferably used. However, the shift position detection mechanism is not limited to a slide type in the present invention. For example, as shown in FIG. 12, a shift position detection mechanism 73 of a rotary type may be used instead of the shift position detection mechanism 50. For example, "displacement" may include "rotation."

As shown in FIG. 12, the shift position detection mechanism 73 is preferably provided with a detected member 71 having a generally cylindrical shape, for example. The detected member 71 is rotatable around a shaft A. The detected member 71 is connected to the wire 47 by a connecting member 74. As the operator operates the control lever 83, the wire 47 moves to cause the detected member 71 to rotate. Therefore, the detected member 71 rotates as much as the angle corresponding to an operation amount of the control lever 83. The rotation angle of the detected member 71 is detected by a rotation angle sensor 75 as a position detection section. The rotation angle sensor 75 outputs the detected rotation angle of the detected member 71 to the control device 91 as a shift position signal. The control device 91 controls the shift position of the shift mechanism 34 on the basis of the shift position signal.

The detected member 71 is provided with a detent mechanism 72 to stop at a position where the control lever 83 is located in the middle position shown in FIG. 6.

In the preferred embodiments described above, a description is provided of a case where the magnetic material 63 is preferably disposed on the slider 53, and magnetism is detected to detect a position of the slider 53. However, the method of detecting the slider 53 is not limited to this case. For example, a position of the slider 53 may be detected by using an optical source and an optical detection sensor.

In addition, the method of updating the reference voltage ($V_{sc}$) is not particularly limited. For example, when a position of the control lever 83 is in the middle position shown in FIG. 6, the reference voltage ($V_{sc}$) stored in the memory 86*b* may be updated on the basis of a voltage output from the position detection section 52.

In the preferred embodiments described above, as shown in FIG. 3, a description is provided of an example where the accelerator opening sensor 46 is preferably disposed on the outboard motor 20. However, a position of the accelerator opening sensor is not particularly limited. For example, an accelerator opening sensor may be disposed in the controller 82. Further, an output of the engine may be directly controlled by the wire 47 without providing the accelerator opening sensor.

In the preferred embodiments described above, a map arranged to control the transmission gear ratio change mechanism 35 and a map arranged to control the shift position change mechanism 36 are preferably stored in the memory 86*b* in the ECU 86 mounted on the outboard motor 20. In addition, a control signal arranged to control electromagnetic valves are output from the CUP 86*a* in the ECU 86 mounted on the outboard motor 20.

However, the present invention is not limited to this structure. For example, the controller 82 mounted on the hull 10 may be provided with a memory as a storage and a CPU as an operation portion together with the memory 86*b* and the CPU 86*a* or instead of the memory 86*b* and the CPU 86*a*. In this case, the map arranged to control the transmission gear ratio change mechanism 35 and the map arranged to control the shift position change mechanism 36 may be stored in the memory provided in the controller 82. Further, the CPU provided in the controller 82 may output a control signal arranged to control the electromagnetic valves.

In the preferred embodiments described above, a description is provided of an example where the ECU 86 preferably performs control of both the engine 30 and the electromagnetic valves. However, the present invention is not limited to this example. For example, an ECU that controls the engine and an ECU that controls the electromagnetic valves may be separately provided.

In the preferred embodiments described above, a description is provided of an example where the shift mechanism 34 preferably has the transmission gear ratio change mechanism 35. However, the shift mechanism 34 may not have the transmission gear ratio change mechanism 35. For example, the shift mechanism 34 may have only the shift position change mechanism 36.

The connection force of a clutch is a value that expresses an engaging state of the clutch. In other words, for example, "the connection force of a transmission gear ratio switch hydraulic clutch is 100%" means that a hydraulic piston is driven to make a plate group to be in a completely pressed state, and that the transmission gear ratio switch hydraulic clutch is in a completely engaged state. On the other hand, for example, "the connection force of the transmission gear ratio switch hydraulic clutch is 0%" means that the hydraulic piston is released from a driven state and plates in the plate group are separated to be in a non-pressed state, and that the transmission gear ratio switch hydraulic clutch is in a completely disengaged state. Further, for example, "the connection force of the transmission gear ratio switch hydraulic clutch is 80%" means that the transmission gear ratio switch hydraulic clutch is driven to make the plate group to be in a pressed state, and that engagement is made such that driving torque transmitted from a first power transmission shaft as an input shaft to a second power transmission shaft as an output shaft or rotational speed of the second power transmission shaft is 80% with respect to a state that the transmission gear ratio switch hydraulic clutch is completely engaged; that is, a state of a so-called half clutch.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propulsion system arranged to be operated by a control lever to change a shift position, the boat propulsion system comprising:

a power source;

a propeller arranged to be driven by the power source;

a shift mechanism disposed between the power source and the propeller and arranged to change a shift position among forward, neutral, and reverse;

a shift position detection mechanism including a detected member arranged to be connected to the control lever with a wire such that the detected member is displaced to a position corresponding to an operation position of the control lever as a result of the operation of the control lever;

a position detection section arranged to detect displacement of the detected member and output a shift position signal corresponding to the detected displacement of the detected member; and a control device arranged to control the shift position of the shift mechanism on the basis of the shift position signal.

2. The boat propulsion system according to claim 1, wherein the shift position detection mechanism includes a frame body having a slide space arranged to allow the detected member to slide therein.

3. The boat propulsion system according to claim 1, wherein the detected member is arranged to be displaced in first and second directions from a neutral position when the control lever is located in a position corresponding to neutral; and the position detection section is arranged to output the shift position signal corresponding to forward when the detected member is displaced from the neutral position in the first direction, and outputs the shift position signal corresponding to reverse when the detected member is displaced from the neutral position in the second direction opposite to the first direction.

4. The boat propulsion system according to claim 3, wherein the position detection section is arranged to output the shift position signal having a voltage whose absolute value of a difference from a reference voltage becomes larger as the detected member is further displaced from the neutral position; and the control device is arranged to set a shift position of the shift mechanism from neutral to forward, or neutral to reverse, when the voltage of the shift position signal becomes greater than the reference voltage by a first predetermined value or more, or when the voltage of the shift position signal becomes less than the reference voltage by a second predetermined value or more; and is arranged to maintain a shift position of the shift mechanism to neutral when the voltage of the shift position signal is within a range from the voltage greater than the reference voltage by the first predetermined value to the voltage less than the reference voltage by the second predetermined value.

5. The boat propulsion system according to claim 4, wherein the control device includes:

a control unit arranged to control the shift position of the shift mechanism on the basis of the shift position signal; and a memory arranged to store the reference voltage, the first predetermined value, the second predetermined value, and at least one of data among the voltage of the shift position signal at the time when the control unit sets the shift position of the shift mechanism to forward, the voltage of the shift position signal at the time when the control unit sets the shift position of the shift mechanism to reverse, and the voltage of the shift position signal at the time when the detected member is located in the neutral position; wherein the control unit is arranged to update the reference voltage stored in the memory on the basis of at least one of the data stored in the memory.

6. The boat propulsion system according to claim 5, wherein the memory is arranged to store an allowable maximum value and an allowable minimum value of the reference voltage; and the control unit includes:

a calculation portion arranged to calculate a possible update value of the reference voltage stored in the memory on the basis of the data stored in the memory; and an update portion arranged to update the reference voltage stored in the memory to be a possible update value of the reference voltage when a possible update value of the reference voltage is equal to or less than an allowable maximum value of the reference voltage and equal to or greater than an allowable minimum value of the reference voltage, to update the reference voltage stored in the memory to be an allowable maximum value of the reference voltage when a possible update value of the reference voltage is greater than an allowable maximum value of the reference voltage, and, on the other hand, to update the reference voltage stored in the memory to be an allowable minimum value of the reference voltage when a possible update value of the reference voltage is less than an allowable minimum value of the reference voltage.

7. The boat propulsion system according to claim 3, wherein the position detection section is arranged to output the shift position signal having a voltage whose absolute value of a difference from the reference voltage becomes larger as the detected member is further displaced from the neutral position; and the control device is arranged to determine an abnormality when the voltage of the shift position signal becomes greater by a predetermined limitation voltage or larger, or becomes less by a predetermined limitation voltage or larger.

8. The boat propulsion system according to claim 3, further comprising:

a neutral sensor that is ON when the detected member is detected to be located in a predetermined area adjacent the neutral position, and which outputs an ON signal to the control device;

the control lever to which an accelerator opening of the power source is input; and an accelerator opening detection section arranged to detect the accelerator opening on the basis of a displacement of the control lever and output the detected accelerator opening to the control device; wherein the control device is arranged to control a shift position of the shift mechanism to neutral regardless of the shift position signal when an ON signal is input from the neutral sensor and detects an abnormality of at least one of the neutral sensor and the position detection section on the basis of at least one of the accelerator opening, the shift position signal, and the ON signal.

9. The boat propulsion system according to claim 8, wherein the control device is arranged to:

set a shift position of the shift mechanism from neutral to forward, or from neutral to reverse, when the voltage of the shift position signal becomes greater than the reference voltage by a first predetermined value, or when the voltage of the shift position signal becomes less than the reference voltage by a second predetermined value;

maintain a shift position of the shift mechanism to neutral when the voltage of the shift position signal is within a range from a voltage greater than the reference voltage by the first predetermined value to a voltage less than the reference voltage by the second predetermined value; and determine an abnormality of the position detection section when the accelerator opening is equal to or larger than a predetermined opening, and when the voltage of the shift position signal is within a range from a voltage greater than the reference voltage by the first predetermined value to a voltage less than the reference voltage by the second predetermined value.

10. The boat propulsion system according to claim 9, wherein the control device is arranged to determine an abnormality of the position detection section when the accelerator opening is equal to or larger than a predetermined opening, when the voltage of the shift position signal is within a range from a voltage greater than the reference voltage by the first predetermined value to a voltage less than the reference voltage by the second predetermined value, and when an ON signal is not output from the neutral sensor.

11. The boat propulsion system according to claim 8, wherein the control device is arranged to detect an abnormality of the neutral sensor when the accelerator opening is equal to or larger than the predetermined opening, and further when an ON signal from the neutral sensor is output.

12. The boat propulsion system according to claim 7, wherein the control device is arranged to restrict an output of the power source when an abnormality is determined.

13. The boat propulsion system according to claim 3, wherein the position detection section includes a magnetic sensor arranged to detect a level of magnetism and arranged to output a voltage of a level corresponding to the level of magnetism as a shift position signal to the control device; and the detected member includes:

a detected member main body;

a first magnetic material mounted on the detected member main body that comes closer to the magnetic sensor as the position detection section is displaced from the neutral position in a first direction; and a second magnetic material having a polarity opposite to the first magnetic material mounted on the detected member main body that comes closer to the magnetic sensor as the position detection section is displaced from the neutral position in a second direction opposite to the first direction.

14. The boat propulsion system according to claim 1, wherein the power source includes an outboard motor.

15. A boat comprising:

the boat propulsion system according to claim 1; and a control lever.

* * * * *